US006431280B2

(12) United States Patent
Bayliss et al.

(10) Patent No.: US 6,431,280 B2
(45) Date of Patent: Aug. 13, 2002

(54) METHOD FOR PLACEMENT OF BLOCKING GELS OR POLYMERS AT SPECIFIC DEPTHS OF PENETRATION INTO OIL AND GAS, AND WATER PRODUCING FORMATIONS

(76) Inventors: Geoffrey Stanley Bayliss; Paul Stuart Bayliss, both of 703 Calthorte, Katy, TX (US) 77450

( * ) Notice: Subject to any disclaimer, the term of this patent is extended or adjusted under 35 U.S.C. 154(b) by 0 days.

(21) Appl. No.: 09/824,403

(22) Filed: Apr. 2, 2001

Related U.S. Application Data

(63) Continuation-in-part of application No. 09/217,474, filed on Dec. 21, 1998, now abandoned.

(51) Int. Cl.[7] ..... E21B 33/138; E21B 43/22

(52) U.S. Cl. ..... 166/263; 166/292; 166/294; 166/295; 166/300

(58) Field of Search ..... 166/263, 270, 166/292, 294, 295, 300; 516/111; 523/130, 131

(56) References Cited

U.S. PATENT DOCUMENTS 2,747,670 A * 5/1956 King et al. ..... 166/270
3,396,790 A * 8/1968 Eaton ..... 166/270
3,502,146 A * 3/1970 Hurd ..... 166/270
3,522,844 A * 8/1970 Abdo ..... 166/270
3,530,937 A 9/1970 Bernard
3,623,842 A 11/1971 Deans
3,747,677 A * 7/1973 Richardson et al. .... 166/270 X
3,841,405 A * 10/1974 Moote et al. ..... 166/294
4,031,958 A * 6/1977 Sandiford et al. ..... 166/270
4,312,635 A 1/1982 Carlisle
4,361,186 A * 11/1982 Kalina ..... 166/295
4,488,601 A * 12/1984 Hammett ..... 166/270
4,494,606 A * 1/1985 Sydansk ..... 166/295
4,552,217 A * 11/1985 Wu et al. ..... 166/270
4,569,393 A 2/1986 Bruning et al.
4,630,678 A 12/1986 Mumallah et al.
4,708,207 A 11/1987 Kalfayan et al.
4,917,186 A * 4/1990 Mumallah ..... 166/295
6,152,234 A * 11/2000 Newhouse et al. ..... 166/270 X

* cited by examiner

*Primary Examiner*—George Suchfield
(74) *Attorney, Agent, or Firm*—Kurt S. Myers

(57) ABSTRACT

This patent relates to a process whereby a filter/seive is produced by injecting the interactive chemicals used to form gels and polymers at reservoir temperatures independently and sequentially into a well in such a manner that the chemicals only come into contact with each other at the desired depth of penetration in the formation. At this location in the reservoir, which can be determined by appropriate calculation, the injection is stopped and the intermixed and superimposed chemicals are allowed to react to form the filter/seive of a gel or polymer depending upon the nature of the individual chemicals injected.

15 Claims, 10 Drawing Sheets

Flow Velocity at Specific Distances from the Wellbore 1000, 1500, 2000, 2500, 3000, 3500, 4000, 5000, 10000 (BWPD)

FIG. 9

DISTANCE OF PENETRATION OF WATER $$rw^2 = V/\pi(H)(\phi)(1-AS_{or})0.1779 \quad \ldots\ldots\ldots\ldots\ldots\ldots\ldots\ldots \quad 1$$

where:

$rw$ = radius of water penetration in feet $V$ = barrels of water injected into well $H$ = height of reservoir interval fluids injected into in feet $\phi$ = porosity of reservoir in unit percent $AS_{or}$ = accessible residual oil saturation in pore space in unit percent 0.1779= conversion constant for bbls/feet/unit percent

FIG. 10

PARTITION COEFFICIENT (K-VALUE)

$$Ke = \frac{Ce_{oil}}{Ce_{water}} \quad \ldots\ldots\ldots\ldots\ldots\ldots\ldots\ldots \quad 2$$

where:

$Ke$ = partition coefficient (K-Value) for equilibrium of chemical e (ester) between accessible residual oil (stationary phase) and injection water (moving phase)

$Ce_{oil}$ = concentration of chemical e (ester) in oil phase at reservoir temperature and injection water salinity conditions $Ce_{water}$= concentration of chemical e (ester) in water phase at reservoir temperature and injection water salinity conditions

FIG. 11

RETARDATION FACTOR FOR CHEMICAL E (ESTER) DUE TO PARTITIONING BETWEEN IMMOBILE ACCESSIBLE RESIDUAL OIL ($AS_{OR}$) AND MOBILE AQUEOUS PHASE $$\beta = Ke(AS_{or}/1-AS_{or}) \quad \ldots \quad 3$$

where:

$\beta$ = retardation factor

Ke = partition coefficient (K-Value) for chemical e (ester) between immobile accessible residual oil phase and mobile injection water phase $AS_{or}$ = accessible residual immobile oil in reservoir pore space expressed as unit percent

FIG. 12

DISTANCE OF PENETRATION OF CHEMICAL E (ESTER)

$$re^2 = rw^2/(1+\beta) \quad \ldots \quad 4$$

where:

re = radius of penetration of the chemical e (ester) from the well-bore into the reservoir in feet rw = radius of penetration of the injected water volume into the reservoir in feet $\beta$ = retardation factor of chemical e (ester) due to partitioning between immobile accessible residual oil ($AS_{or}$) and mobile aqueous phase

METHOD FOR PLACEMENT OF BLOCKING GELS OR POLYMERS AT SPECIFIC DEPTHS OF PENETRATION INTO OIL AND GAS, AND WATER PRODUCING FORMATIONS

RELATED APPLICATION

This application is a continuation-in-part of U. S. application Ser. No. 09/217,474, filed Dec. 21, 1998 now abandoned, entitled "Method for Placement of Blocking Gels or Polymers at Specific Depths of Penetration into Oil and Gas, and Water Producing Formations"

FIELD OF INVENTION

This invention relates to the stoppage of water flow while permitting the recovery of hydrocarbons from a hydrocarbon formation in the earth.

Specifically, it relates to the placement of a filter/sieve of a blocking gel or polymer at a predetermined distance from a well bore in order to stop water flow and to thereby enhance the recovery of oil and gas hydrocarbons from the formation.

BACKGROUND OF THE INVENTION

It is well known that the economic life expectancy of commercially productive oil and gas wells is determined by the transitional change with time from the well being predominantly oil and gas producing to increasingly becoming water productive. Under the best conditions the production of oil and gas only diminishes consistent with the depletion of the contained resource and at the uneconomic high water cut point the reservoir contains both non-produced mobile oil and gas and non-mobile residual oil and gas. At this high water cut point, the well is considered to be uneconomic for production of hydrocarbon from the specific perforated reservoir formation or interval and, as a consequence, production from that reservoir formation at that well location is abandoned. The quantity of residual oil remaining at this point however, is quite significant and residual oil saturation can range anywhere from 10 pore volume percent to in excess of 50 pore volume percent of the original oil or gas in place. This estimate does not take into account any volume of bypassed oil present in the reservoir.

The increasing production of water from a reservoir interval can also be attributed to other mechanisms such as water or gas coning, or early breakthrough of water or gas from high permeability zones present within the reservoir formation being produced.

Similar remarks apply to the injection of fluids into reservoir formations; the fluid flow profiles can be homogeneous or can be channeled into the formation by preferential flow through the higher permeability zones.

Blockage of high permeability zones within oil and gas productive reservoir has been commonly applied in the oil and gas industry as a means of reducing unwanted water and gas flow and improving oil and gas production. Both inorganic and organic gels and polymers have been used and there are a multitude of patents applicable to this type of blockage.

The common mode of operation is to inject into the well either preformed gels or polymer mixes or mixtures of chemicals which will interact at reservoir temperatures to form gels or polymer mixes with time. The ensuing plugging or blocking effects of these gels or polymers then inhibits the preferential production of water from the formation.

Problems most commonly experienced with the injection of preformed gels or polymer mixtures relate to inadequate depths of penetration into the formation followed by early breakdown of the blocking gel or polymer during the reverse production flow from the reservoir.

Injection of mixtures of gel or polymer forming chemicals with a secondary reactive chemical which induces gelation or polymer formation at depth in the reservoir suffers mainly in one being unable to control the reaction rate such that premature reaction does not occur prior to the chemical mixture being located at the desired depth of penetration. Premature gelation or polymerization of these chemical mixtures will often occur resulting in premature blockage at short distances (less than four feet) of penetration into the formation as is the case for direct gel or polymer injection. Formation of gels and polymers during the residence time spent by the chemical mixtures in the well bore during the injection is also a problem. Attempts have been made to diminish this effect by using coiled tubing to more speedily place the chemical mixes into the formation as well as using surfactant-emulsion transport of less water soluble and slower reacting acid forming chemicals.

Previous patent coverage relates to the use of Single Well Chemical Tracer technology for the measurement of residual oil saturation of watered-out reservoir formations (U.S. Pat. No. 3,623,842 (Nov. 30, 1971); Deans, H. A.: "Method for Determining Fluid Saturations in Reservoirs.") U.S. Pat. No. 4,312,635, issued to Carlisle on Jan. 26, 1982, provides background information for the determination of partition coefficients, which are discussed further below.

In Deans' process, a volume of water (seawater, fresh water or formation water) containing a known concentration of reactive chemical tracer is injected into a watered out reservoir formation followed by the injection of a predetermined volume of water (push volume) such that the chemical tracer fluid volume is pushed into the reservoir to a desired distance. The reactive chemical tracer used is a chemical which has the ability to partition between the residual oil present as a stationary phase in the reservoir and the water phase which is moving through the reservoir consistent with the injection flow rate.

The partitioning effect between the reactive chemical and the stationary residual oil reduces the velocity of flow of the reactive chemical tracer bank relative to the water flow. Following injection of the chemical mix and the push volumes, the well is shut-in to allow the reactive chemical tracer to react with water to form a secondary nonreactive chemical product at the location of the reactive chemical tracer bank. Reaction time is controlled such that between 20–40 volume percent of the reactive tracer is converted to the secondary product tracer. Back production of the injected fluids and measurement of the returning reactive tracer and chemical product concentrations allows a determination of the accessible residual oil saturation ($AS_{or}$) for the test interval to be made.

The preferred reactive chemical tracers used in the accessible residual oil saturation ($AS_{or}$) measurement process are water soluble esters such as ethyl formate, methyl acetate, ethyl acetate among others. Hydrolysis of these chemicals under reservoir conditions form the corresponding acid and alcohol components making up that specific reactive tracer chemical. As a consequence of the acid formation, the hydrogen ion concentration or acidity (pH) will correspondingly increase.

Patents for the use of inorganic and organic gels and polymers as blocking agents in reservoir formations do exist. In most instances where inorganic gel chemicals have been used, the gel formation is initiated by mixing the gel progenitor chemical with inorganic acid or organic acid and alcohol chemicals. Chemical esters have been reported as a means of forming gels by the in situ generation of acid and alcohol components which correspondingly change the pH and initiate gelation or polymerization. However, such use of esters has only been applied to the mixing of the ester with the gel forming agent at the surface followed by co-injection of the chemicals into the reservoir.

SUMMARY OF THE INVENTION

This patent application relates to a process whereby a filter/seive is produced by injecting the interactive chemicals used to form gels and polymers at reservoir temperatures independently and sequentially into a well in such a manner that the chemicals only come into contact with each other at the desired depth of penetration in the formation. At this location in the reservoir, which can be determined by appropriate calculation, the injection is stopped and the intermixed and superimposed chemicals are allowed to react to form the filter/seive of a gel or polymer depending upon the nature of the individual chemicals injected.

Since no reaction takes place during the injection phase, premature gelation or polymerization cannot occur at any point other than where the chemicals come into contact each with the other. Furthermore, by using this placement process not only can the gel or polymer blockage, namely, the desired filter/sieve structure, be located at a depth of penetration (between four and thirty feet) where the velocity flow for either the injection or production of fluids into or from the reservoir interval is ideal for maintaining the blockage of water, but the thickness of the filter/sieve can also be predetermined by using appropriate volumes of the injected chemicals and nonchemical containing push volumes.

BRIEF DESCRIPTION OF THE DRAWINGS

FIG. 9 is a mathematical formula for distance of penetration of water.

FIG. 10 is a mathematical formula for partition coefficient (K-Value).

FIG. 11 is a mathematical formula for retardation factor for chemical e (ester) due to partitioning between immobile accessible residual oil ($AS_{or}$) and mobile aqueous phase.

FIG. 12 is a mathematical formula for distance of penetration of chemical e (ester).

DETAILED DESCRIPTION OF THE PREFERRED EMBODIMENT

Figure 1A:
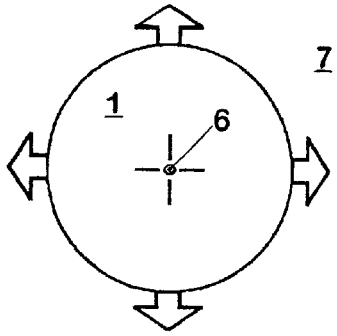
FIG. 1A is a top depiction of the injection of a reservoir conditioning fluid flood, volume $V_1$ 1, into the reservoir interval 7.

In general, the present invention relates to forming a filter/sieve or a blockage zone of a gel or polymer at a desired depth of penetration in a reservoir formation that ensures blockage and prevents water breakthrough into the well. More specifically, the present invention relates to the emplacement of two (2) or more reactive chemicals at a common location at a desired depth of penetration in a reservoir formation such that ensuing chemical gelation or polymerization will form a filter/sieve or blockage zone of predetermined size in an appropriate low velocity flow environment preferentially in high water cut permeability zones.

The present invention employs reactive fluid(s) or chemical(s) which re water soluble chemical(s) having solubility in both water and oil, and which have the ability to undergo reaction at reservoir conditions to form the desired filter/sieve or block one of gel or polymer within an underground formation at a desired distance from the well. The process employs either an organic ester and a silicate or a soluble polymer and a multivalent salt. The process is unique in that the choice of chemicals and the independent injection of the chemicals into the formation with each chemical bank being pushed further out into the formation with predetermined push volumes of fresh water, treated fresh water, seawater, treated seawater, formation water or treated formation water, results in a predetermined retardation in the flow of the reactive chemicals(s) by partitioning interaction with the immobile accessible residual oil in the formation and the ensuing non-retarded flow of the gel or polymer forming chemicals resulting in the gel or polymer forming chemical bank proceeding to catch up to, and superimposing itself upon, the slower moving reactive chemical bank at a predetermined distance and thickness from the well bore and at a location ideal for low velocity flow conditions.

In situ reaction of the reactive chemicals and gel or polymer forming chemicals at reservoir conditions and the subsequent inter-reaction of the reaction products with the gel or polymer progenitor chemicals results in the formation of a filter/sieve or blocking zone of stable gel or polymer which effectively reduces water flow from any preferentially invaded high permeability high water cut zones. A unique aspect of the location of the filter/sieve at a desired depth of penetration around a production well is that it allows the oil and/or gas to flow through the filter/sieve, blocking the water, thereby allowing commercial enhanced oil and/or gas production utilizing the in situ formation drive mechanism.

The process can have application in oil wells, gas wells, or in depleted high water cut oil and gas wells containing remaining mobile oil. For filter/sieve or blockage emplacement in formations which have no residual oil, preconditioning of the formation by oil or diesel injection followed by water flood can render the formation suitable for ensuing gel or polymer blockage according to the described process.

The reservoir may be initially preconditioned by the injection of a predetermined volume of fresh water, pretreated water, seawater, pretreated seawater, formation water or pretreated formation water such that (1) any mobile oil and/or gas is displaced from the immediate reservoir interval consistent with the injection, leaving only a small amount of residual oil, or introducing a residual amount of oil if none is present and (2) the temperature of the reservoir interval is lowered to a value suitable for controlled reaction of the reactive chemicals and (3) divalent inorganic ions such as $Ca^{++}$ and $Mg^{++}$ are removed from the formation waters in the volume of reservoir being used in the process since they would react prematurely with the reactant chemicals injected.

For onshore wells, in many instances fresh water or pretreated water can be used for introducing the chemicals , the chemical mixture volumes, and the injection and push volumes designed for a specific filter/sieve or blockage placement. For offshore and nearshore wells, realistically only seawater is conveniently available and its preferred use is of significant economic benefit. The interaction between ungelled solutions such as sodium silicate and seawater which contains approximately 400 ppm $Ca^{++}$ and 1350 ppm $Mg^{++}$ instantly results in the precipitation of insoluble calcium and magnesium silicates. If the seawater is treated by the injection of the appropriate molar quantity of EDTA (Ethylene diaminetetraacetic acid tetrasodium salt) immediately preceding the injection of the gel progenitor, sodium silicate, into the EDTA treated seawater stream, no reaction occurs and the gel progenitor chemical remains in solution during its subsequent placement into the reservoir zone.

The use of EDTA (Ethylene diaminetetraacetic acid tetrasodium salt) in this process, and made a specific part of this application, is entirely to render the use of seawater suitable for offshore well operations involving gel or polymer blockage placement at predesired locations in the reservoir interval. Since seawater is the preferred fluid of choice for use in most offshore well processes, the use of EDTA as a means of stabilizing $Ca^{++}$ and $Mg^{++}$ ions in seawater is a claim of this patent application.

The chemical emplacement and the subsequent gelation or polymerization on process is illustrated by a description of a preferred embodiment of the present invention in which an oil-water partitioning reactive chemical, ethyl formade, is injected into the well followed by the injection of a second, water soluble chemical, sodium silicate, along with appropriate spacer push volumes called to achieve the desired depth of penetration (see FIGS. 9–12).

Figure 1B:
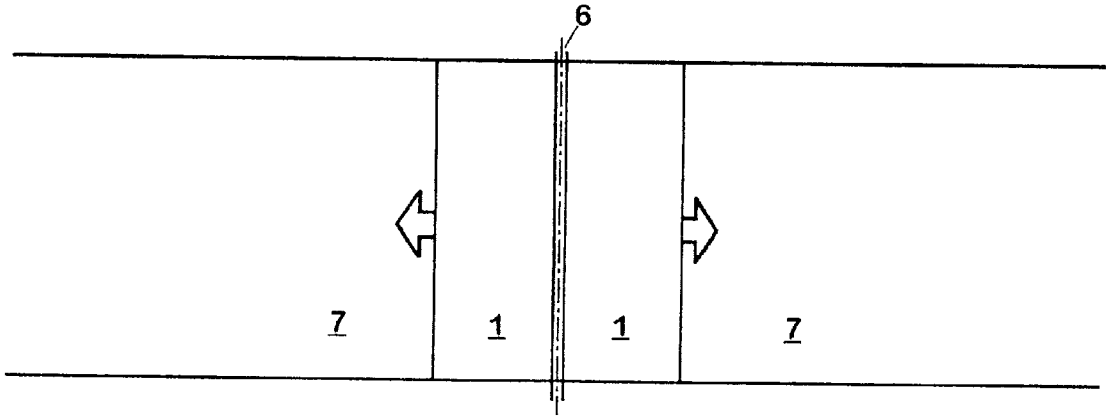
FIG. 1B is a sectional depiction of the injection of a reservoir conditioning fluid flood, volume $V_1$ 1, into the reservoir interval 7.

In FIG. 1A and FIG. 1B, a preconditioning volume $V_1$ 1 of fresh water, treated water, seawater, treated seawater, formation water or treated formation water is injected into the reservoir 7, as shown for ideal radial flow penetration from the well bore 6.

Figure 2A:
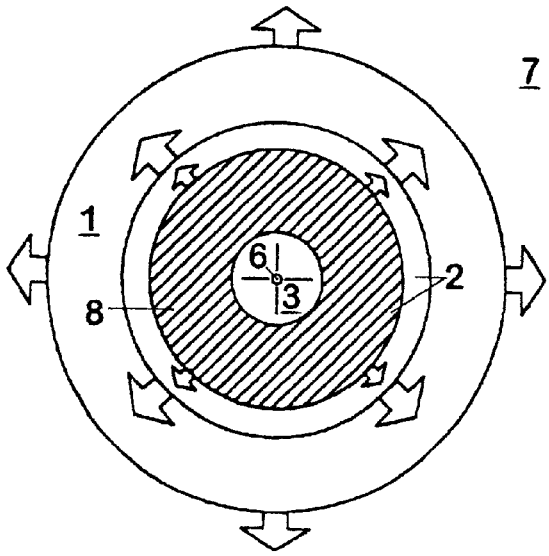
FIG. 2A is a top depiction of the injection of the reactive chemical flood volume, $V_{2\ 2}$.
Figure 2B:
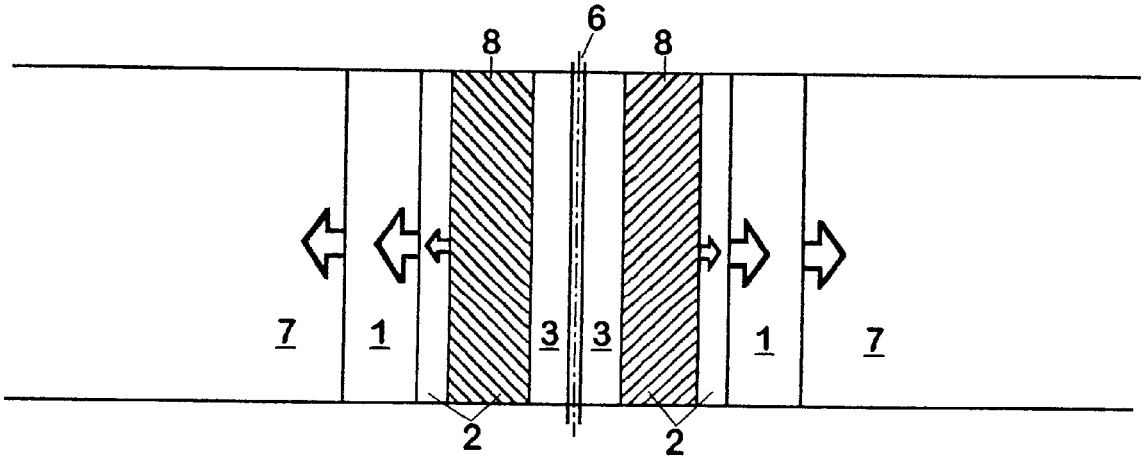
FIG. 2B is a sectional depiction of the injection of the reactive chemical flood volume, $V_2$ 2.

Following injection of volume $V_1$ 1, the reactive chemical mixture 8 consisting of x volume percent of ethyl formate in the appropriate volume of water, $V_2$ 2, is injected into the reservoir 7 at the same predetermined injection rate as for volume $V_1$ 1. FIG. 2A and FIG. 2B illustrate the ensuing distribution of the volume $V_1$ 1 and $V_2$ 2 fluids in the reservoir 7. Because of the partitioning of the ethyl formate reactive chemical 8 between the water mobile phase and the immobile residual oil phase, the velocity of flow of the ethyl formate 8 will be reduced relative to the water flow velocity and the ethyl formate chemical 8 bank will be retarded. The relative velocity flows are represented by the differently sized arrows shown on the Figures.

Figure 3A:
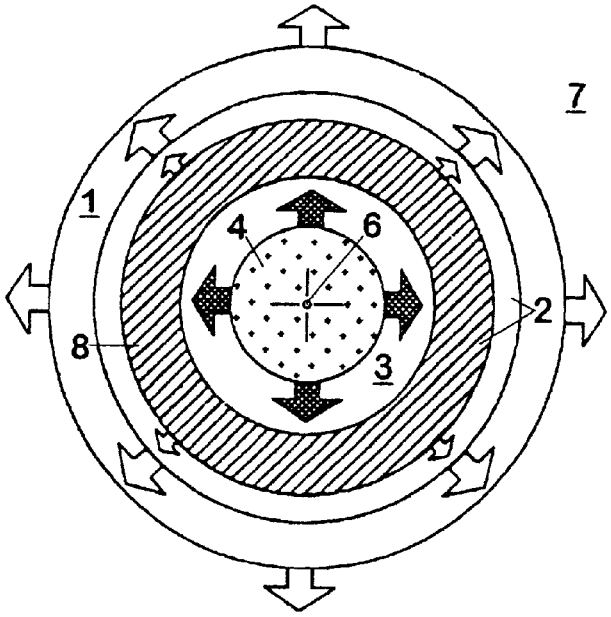
FIG. 3A is a top depiction of the injection of the reactive chemical push volume, $V_3$ 3.
Figure 3B:
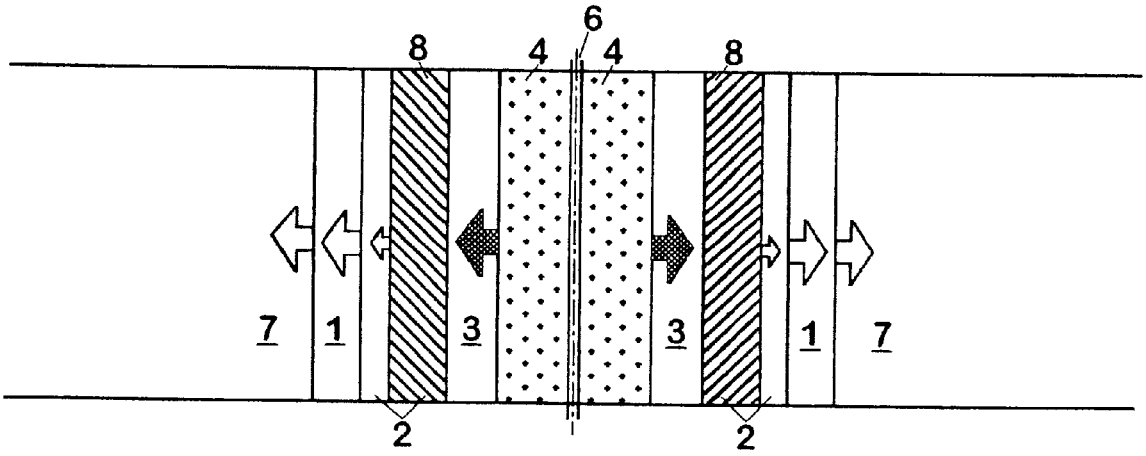
FIG. 3B is a sectional depiction of the injection of the reactive chemical push volume, $V_3$ 3.

Upon completion of the reactive chemical ester ethyl formate 8 injection phase, the chemical mix bank is pushed out into the reservoir by the continued injection of a predetermined volume $V_3$ 3 of water at the established injection rate such that the intermediate location of the reactive ethyl formate bank 8 will be at the point required. Immediately following upon the injection of volume $V_3$ 3 the injection of the gel progenitor sodium silicate solution at a weight percent concentration of y in water 4 is started without interruption of the injection flow. The above injections of volume $V_3$ 3 and the start of the gel progenitor bank, $V_4$ 4, are shown in FIG. 3A and FIG. 3B. As can be seen the velocity of flow for both these volumes are the same, are identical to that for the preflood injection volume $V_1$ 1, and are greater than the velocity flow of the reactive ester ethyl formate bank 8 which continues to be retarded by partitioning with the immobile residual oil.

Figure 4A:
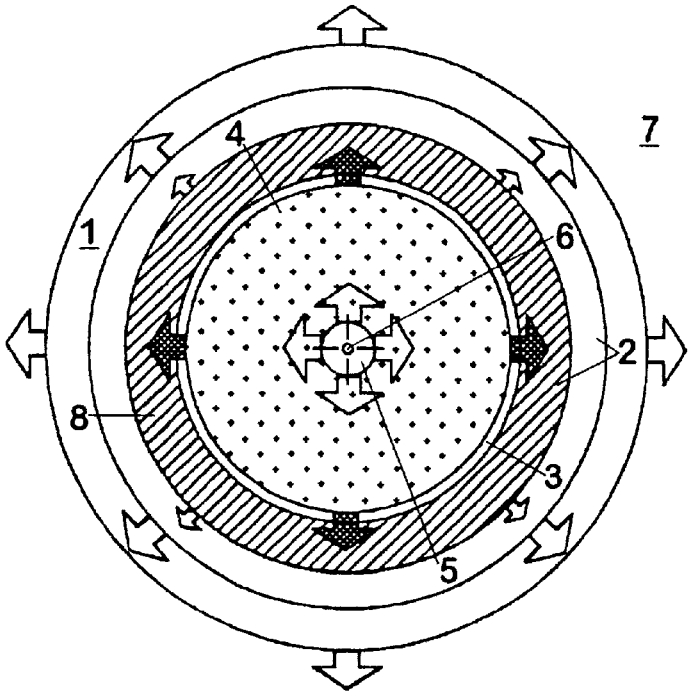
FIG. 4A is a top depiction of the injection of the progenitor gel or polymer forming chemical, volume $V_4$ 4.
Figure 4B:
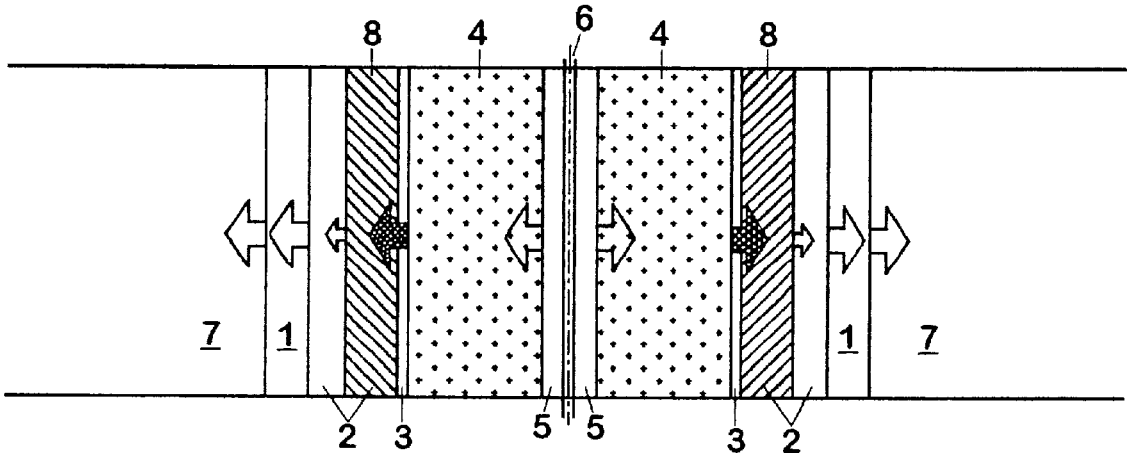
FIG. 4B is a sectional depiction of the injection of the progenitor gel or polymer forming chemical, volume $V_4$ 4.

As a consequence, continued injection of the progenitor gel sodium silicate volume $V_4$ 4 will result in the progenitor gel sodium silicate bank 4 beginning to catch up to, and ultimately encompass, the reactive ester ethyl formate bank 8, volume $V_2$ 2. The fluid distribution at the end of the progenitor gel sodium silicate volume $V_4$ 4 injection and the start of injection of the gel chemical push volume $V_5$ 5 will be as shown in FIG. 4A and FIG. 4B.

Figure 5A:
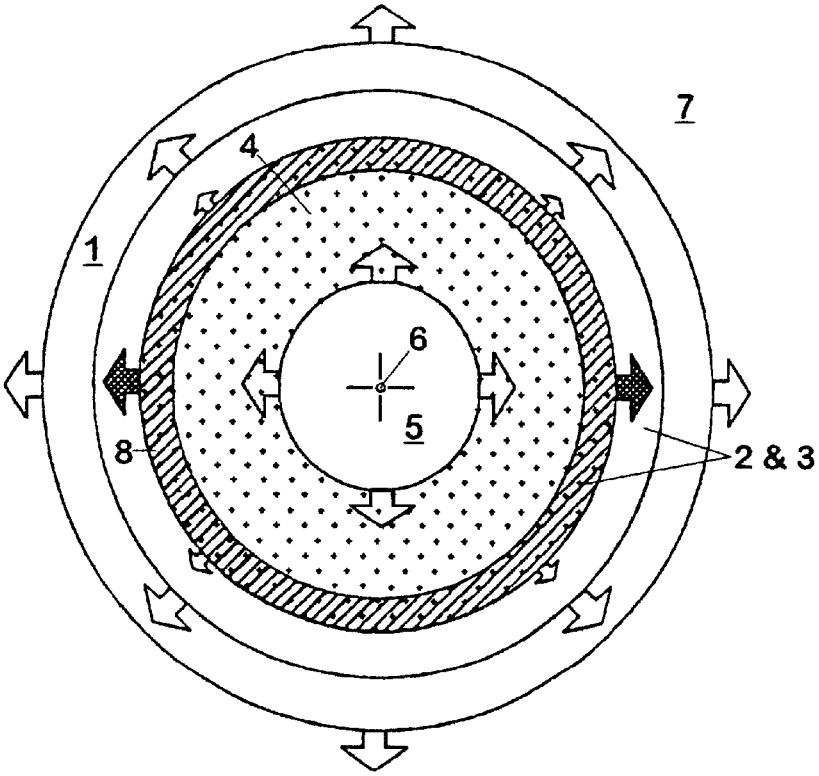
FIG. 5A is a top depiction of the injection of the gel or polymer chemical push volume, $V_5$ 5.
Figure 5B:
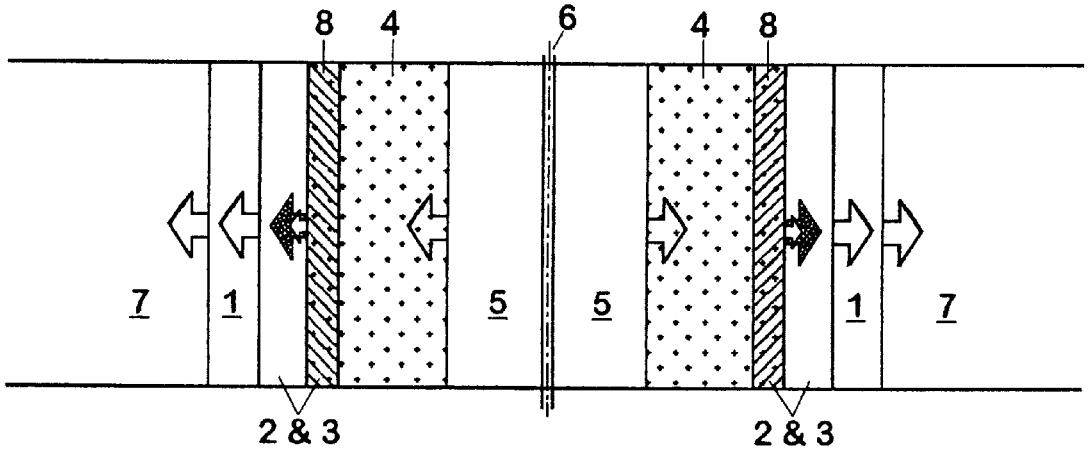
FIG. 5B is a sectional depiction of the injection of the gel or polymer chemical push volume, $V_5$ 5.
Figure 6A:
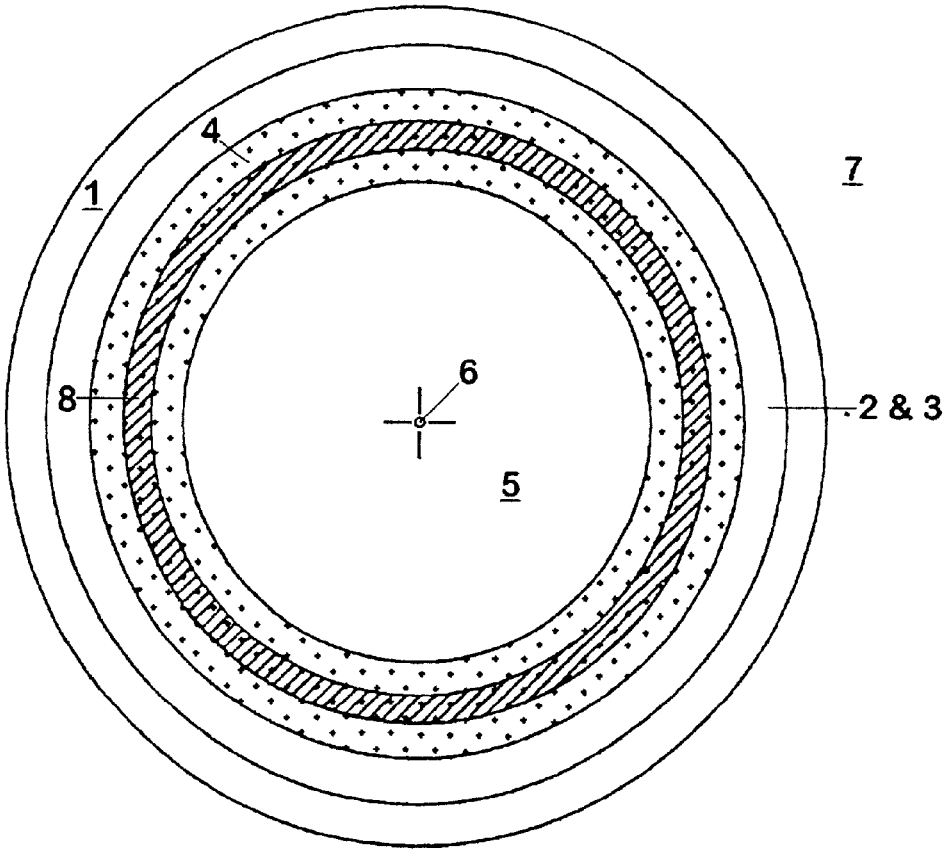
FIG. 6A is a top depiction of the locations of the reactive chemical 8 and the gel progenitor chemical 4 at the well shut-in point.
Figure 6B:
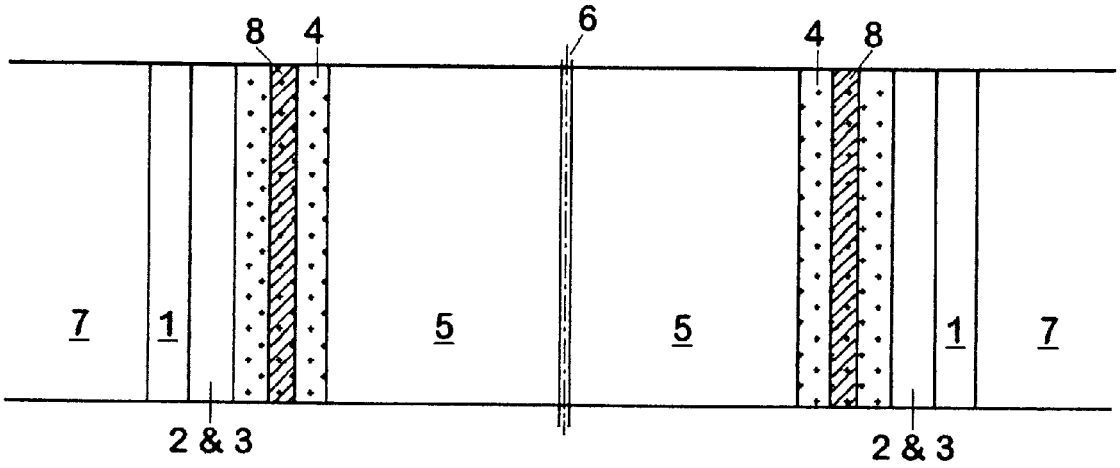
FIG. 6B is a sectional depiction of the locations of the reactive chemical 8 and the gel progenitor chemical 4 at the well shut-in point.

Continued injection of the gel chemical push volume, for a volume $V_5$ 5 will allow the progenitor gel sodium silicate bank 4 to superimpose itself on top of the reactive ethyl formate chemical bank 8 located at the desired depth of penetration into the reservoir formation 7 as shown in FIG. 5A and FIG. 5B. The fluid distributions after the continuous injection of volumes $V_1$ 1, $V_2$ 2, $V_3$ 3, $V_4$ 4 and $V_5$ 5 are as shown in FIG. 6A and FIG. 6B and at this point, injection of fluids is stopped and the well is shut-in. Throughout the injection phase of the process, the reactive ethyl formate bank 8 will increase in concentration due to its partitioning between the accessible residual oil and the injected water flow but will also be undergoing some hydrolysis into its product components, ethanol and formic acid. Since both ethanol and formic acid have a zero partition coefficient with respect to the immobile accessible residual oil which is retarding the flow of the reactive ethyl formate bank 8, the hydrolysis products will immediately assume the increased velocity flow of the unretarded carrier fluids and will move ahead of the unreacted ethyl formate bank 8. As a result these chemicals too will always be in advance of the unreacted ethyl formate bank 8 and hence will not cause unwanted pre-gelation of the following sodium silicate bank 4 until the desired superimposition has been achieved. The partition coefficient for ethyl formate is approximately 3.0 whereas the sodium silicate has a zero (0.0) partition coefficient. Water also has a zero (0.0) partitioning coefficient value. Another way of describing the partitioning coefficient of any chemical between oil and water is that in the case cited, ethyl formate will spend approximately three times longer in the oil phase than in the water phase during the injection process.

During the shut-in period, which is determined based on the rate of hydrolysis of the reactive ester, ethyl formate 8, and the reactant concentrations of the reactive ester ethyl formate 8 and the gel progenitor sodium silicate banks 4, the reactive ethyl formate 8 is converted in situ to the component chemicals ethanol and formic acid.

The presence of generated formic acid makes the ethyl formate bank 8 acidic at a pH of approximately 3.0–3.5 which in turn results in (1) enhanced catalytic hydrolysis of unhydrolyzed remaining ethyl formate 8 with further generation of formic acid and ethanol, and (2) causes subsequent gelation of the sodium silicate solution 4 superimposed on top of this reactive ethyl formate-formic acid-ethanol zone 8. The presence of ethanol also initiates gel formation as too does the ensuing increase in temperature of the injected fluids resulting from attaining equilibrium with reservoir temperature during the shut-in time.

Figure 7A:
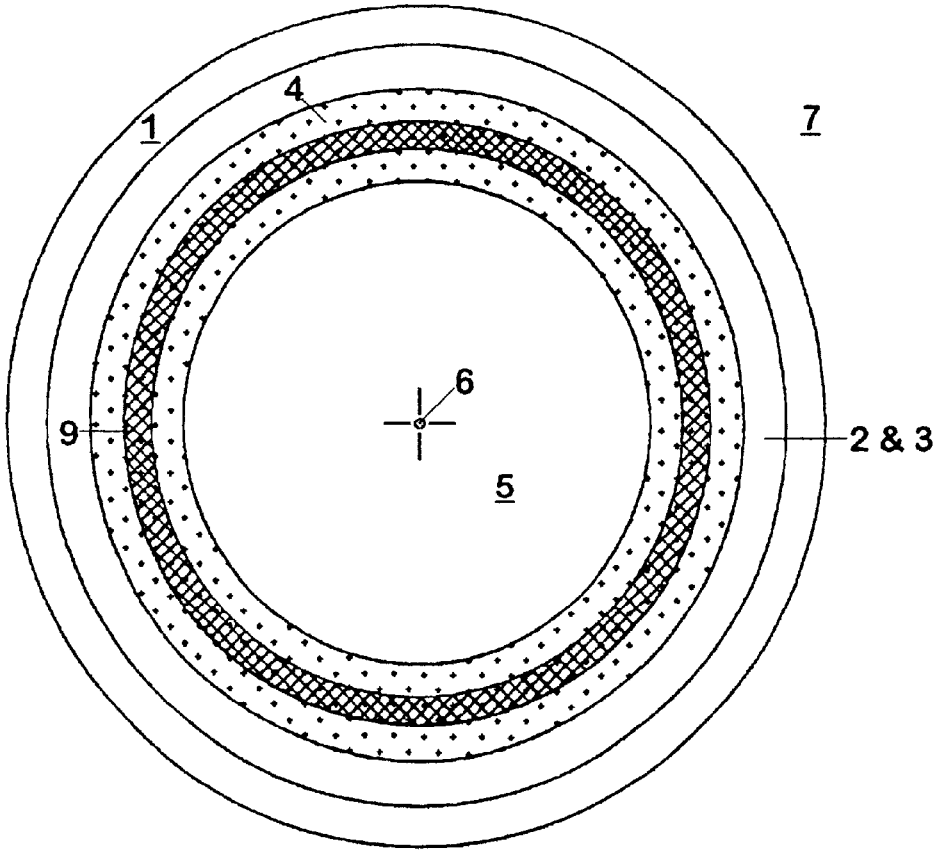
FIG. 7A is a top depiction of the ensuing formation of the gel 9 at the desired location in the reservoir formation 7.
Figure 7B:
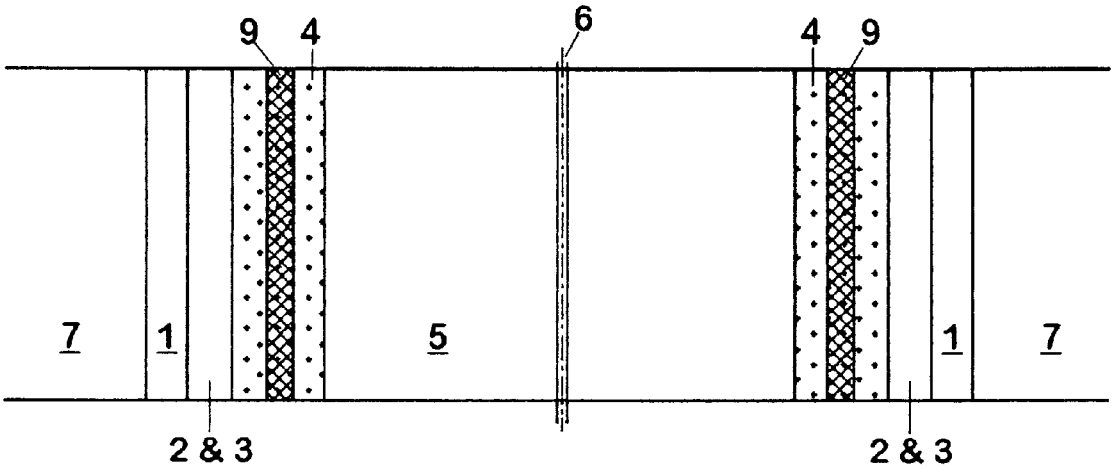
FIG. 7B is a sectional depiction of the ensuing formation of the gel 9 at the desired location in the reservoir formation 7.

The location of the gel blocking chemical 9 or more specifically the desired formation of a filter/sieve of the present invention is shown in FIG. 7A and FIG. 7B.

During the subsequent production of fluids from the well following the fiflter/sieve 9 placement, one would expect the ethanol and formic acid hydrolysis products, formed during the injection phase and which moved ahead of the ethyl formate bank 8, will also return towards the well bore 6. These hydrolysis products will further initiate gelation of unreacted sodium silicate gel progenitor within the pore space at the leading edge of the superimposed silicate bank 4.

The present invention is further illustrated by the following specific examples.

EXAMPLE 1

In the tables below, the volumes, $V_1$ through $V_7$, correspond to the discussion above and to FIGS. 1A through 7B discussed in the detailed description of the preferred embodiment.

At a rate of 1500 bbls water per day 500 bbls ($V_1$) of waterflood seawater were injected in order (1) to remove mobile oil from the vicinity of the well-bore and (2) to cool the reservoir interval to approximately 30–35° C. Injection flow was continued at 1500 bbls water per day with 300 bbls ($V_2$) of seawater containing 2.0 volume percent Ethyl Formate, 0.5 volume percent Isopropanol and 0.5 volume percent Methanol. The reactive chemical volume ($V_2$) was pushed into the reservoir with 300 bbls ($V_3$) of seawater containing the appropriate molar concentration of EDTA (Ethylene diaminetetraacetic acid tetrasodium salt) in order to chelate with the $Ca^{++}$ and $Mg^{++}$ ions present in the seawater and to prevent interaction between these ions and the ungelled polymer progenitor chemical. At the same injection rate of 1500 bbls water per day, 500 bbls ($V_4$) of 3.0–10.0 weight percent ungelled sodium silicate solution in seawater, pretreated with the appropriate molar concentration of EDTA (Ethylene diaminetetraacetic acid tetrasodium salt), was injected followed by a 100 bbls ($V_5$)) seawater volume also containing the appropriate molar concentration of EDTA (Ethylene diaminetetraacetic acid tetrasodium salt). The injected waterflood ($V_1$), chemical banks ($V_2$ and $V_4$) and isolation EDTA banks ($V_3$ and $V_4$) were pushed to the required distances of penetration from the well-bore by a final injection of 400 bbls ($V_6$) of untagged seawater and 100 bbls ($V_7$) of seawater required to fill the tubulars.

For a reservoir interval of 10 meters (32.81 feet) thickness, a porosity of 30%, a residual oil saturation of 30 p.v. % and a Partition Coefficient (Kvalue) for Ethyl Formate between seawater, and immobile residual oil in the reservoir =3.0, the radial distances of penetration for each volume bank (not adjusting for angular and radial dispersion effects), are as shown in Table I.

TABLE I

RADIAL DISTANCES OF PENETRATION FOR VOLUMES $V_1$, $V_2$, $V_3$, $V_4$,$V_5$, $V_6$ AND $V_7$ NOT ADJUSTING FOR ANGULAR AND RADIAL DISPERSION

| Event | Vol | Volume (bbls) | Accum Volume | Radial Distance of Penetration rw(ft) | re(ft) | rw(m) | re(m) |
|---|---|---|---|---|---|---|---|
| Tubular Volume | 7 | 100 | 0 | 0.00 | 0.00 | 0.00 | 0.00 |
| Seawater Push | 6 | 400 | 400 | 10.19 | | 3.10 | |
| Seawater/EDTA Push | 5 | 100 | 500 | 11.40 | | 3.47 | |
| Seawater/EDTA/Gel Progenitor | 4 | 500 | 1000 | 16.12 | | 4.91 | |
| Seawater/EDTA Push | 3 | 300 | 1300 | 18.35 | 12.17 | 5.60 | 3.71 |
| Chemical Mix | 2 | 300 | 1600 | 20.39 | 13.50 | 6.21 | 4.11 |
| Waterflood Seawater | 1 | 500 | 2100 | 23.35 | | 7.11 | |

In this Example, the gel formation zone would be at a distance between approximately 12.17 feet and 13.50 feet (1.33 feet thick) from the well-bore at which point the flow velocity at a production rate of 5000 BOPD would be at 0.1 feet per minute.

In the above example, rw(ft) refers to the radial distance of penetration from the well bore following the respective injected accumulative volume of fluid. Hence, the last injected volume, $V_7$, only displaces the well bore volume (100 bbls) and the radial distance of penetration into the reservoir is zero. Similarly, the maximum radial distance of fluid penetration, 23.35 feet, is computed on the accumulative test injection volume of 2,200 bbls.

The re(ft) refers to the distance of penetration achieved by the reactive chemical bank at its leading edge and at its trailing edge following its retardation resulting from its partitioning action with the immobile accessible residual oil in the formation. The computed re(ft) values for the ethyl formate allows one to calculate the filter/sieve or gel blockage thickness at the distance required in the reservoir.

EXAMPLE 2

For the same reservoir criteria and the same injection volumes $V_1$, $V_2$, $V_3$, $V_4$, $V_5$), $V_6$ and $V_7$ and only changing the reactive chemical volume, $V_2$, to 900 bbls of 2.0 volume percent Ethyl Formate, 0.5 volume percent Isopropanol and 0.5 volume percent methanol injected at a constant 1500 BWPD rate, the radial distances of penetration for the various injection banks will be as shown in Table II.

TABLE II

RADIAL DISTANCES OF PENETRATION FOR VOLUMES $V_1$, $V_2$, $V_3$, $V_4$, $V_5$, $V_6$ AND V7 NOT ADJUSTING FOR ANGULAR AND RADIAL DISPERSION

| Event | Vol | Volume (bbls) | Accum Volume | Radial Distance of Penetration rw(ft) | re(ft) | rw(m) | re(m) |
|---|---|---|---|---|---|---|---|
| Tubular Seawater Volume | 7 | 100 | 0 | 0.00 | | 0.00 | |
| Seawater Push Volume | 6 | 400 | 400 | 10.19 | | 3.11 | |
| Seawater/EDTA Push Volume | 5 | 100 | 500 | 11.39 | | 3.47 | |
| Seawater/EDTA/Gel Progenitor | 4 | 500 | 1000 | 16.11 | | 4.91 | |
| Seawater/EDTA Push Volume | 3 | 300 | 1300 | 18.37 | 12.15 | 5.60 | 3.70 |
| Chemical Mix Volume | 2 | 900 | 2200 | 23.90 | 15.81 | 7.28 | 4.82 |
| Waterflood Seawater Volume | 1 | 500 | 2700 | 26.48 | | 8.07 | |

The filter/sieve or gel block zone for this test would be at a distance between approximately 12.15 feet and 15.81 feet (3.66 feet thick) from the well-bore at which point the flow velocity for a production rate of 5000 BOPD would be less than 0.05 feet per minute.

For the two (2) examples shown, the various injection banks were placed in the reservoir at a 1500 BWPD injection rate which would involve total injection times of 1.46 and 1.86 days respectively. Ethyl formate rates of hydrolysis at reservoir temperatures between 35° C.–50° C., will be approximately 0.3 days$^{-1}$; i.e. a measurable amount of the Ethyl Formate will already have reacted prior to coming into contact with the gel forming chemical bank.

Increasing the rate of injection of the specified volumes to 3000 BWPD or 5000 BWPD will only result in reduction in the injection times to 0.73 and 0.44 (3000 rate), and 0.93 and 0.56 days (5000 rate) respectively. Clearly the degree of hydrolysis will be correspondingly reduced prior to mixing of the chemicals in the reservoir.

EXAMPLE 3

For comparable volumes of injectants to those presented in Examples 1 and 2 but for a reservoir interval of only 10 feet thickness, the distances of penetration will be correspondingly greater. For volumes $V_1$, $V_2$, $V_3$, $V_4$, $V_5$, $V_6$ and $V_7$ as shown in Example 1, the distances of penetration would be as shown in Table III.

TABLE III

RADIAL DISTANCES OF PENETRATION FOR VOLUMES $V_1$, $V_2$, $V_3$, $V_4$, $V_5$, $V_6$ AND $V_7$ NOT ADJUSTING FOR ANGULAR AND RADIAL DISPERSION

| Event | Vol | Volume (bbls) | Accum Volume | Radial Distance of Penetration rw(ft) | re(ft) | rw(m) | re(m) |
|---|---|---|---|---|---|---|---|
| Tubular Seawater Volume | 7 | 100 | 0 | 0.00 | | 0.00 | |
| Seawater Push Volume | 6 | 400 | 400 | 18.46 | | 5.63 | |
| Seawater/EDTA Push Volume | 5 | 100 | 500 | 20.64 | | 6.29 | |
| Seawater/EDTA/Gel Progenitor | 4 | 500 | 1000 | 29.19 | | 8.90 | |
| Seawater/EDTA Push Volume | 3 | 300 | 1300 | 33.28 | 22.04 | 10.14 | 6.72 |
| Chemical Mix Volume | 2 | 300 | 1600 | 36.92 | 24.45 | 11.25 | 7.45 |
| Waterflood Seawater Volume | 1 | 500 | 2100 | 42.29 | | 12.89 | |

In this case the filter/sieve or gel block would form between 22.04 feet and 24.45 feet (2.41 feet thick) from the well-bore with the gel progenitor being placed at a distance of 20.64 feet to 29.19 feet (8.55 feet thick) into the reservoir.

Velocity flow at these distances of reservoir penetration will be very low and should be insufficient for physical breakdown of the gel by fluid flow.

EXAMPLE 4

For comparable volumes as used in Example 2 but for a 10 foot thick reservoir interval the distances of penetration would be as shown in Table IV.

TABLE IV

RADIAL DISTANCES OF PENETRATION FOR VOLUMES $V_1$, $V_2$, $V_3$, $V_4$, $V_5$, $V_6$ AND $V_7$ NOT ADJUSTING FOR ANGULAR AND RADIAL DISPERSION

| Event | Vol | Volume (bbls) | Accum Volume | Radial Distance of Penetration rw(ft) | re(ft) | rw(m) | re(m) |
|---|---|---|---|---|---|---|---|
| Tubular Seawater Volume | 7 | 100 | 0 | 0.00 | | 0.00 | |
| Seawater Push Volume | 6 | 400 | 400 | 18.46 | | 5.63 | |
| Seawater/EDTA Push Volume | 5 | 100 | 500 | 20.64 | | 6.29 | |
| Seawatr/EDTA/Gel Progenitor | 4 | 500 | 1000 | 29.19 | | 8.90 | |
| Seawater/EDTA Push Volume | 3 | 300 | 1300 | 33.28 | 22.04 | 10.14 | 6.72 |
| Chemical Mix Volume | 2 | 900 | 2200 | 43.29 | 28.67 | 13.19 | 8.74 |
| Waterflood Seawater Volume | 1 | 500 | 2700 | 47.96 | | 14.62 | |

As can be seen the filter/sieve or gel blockage zone would be at 22.04 feet to 28.67 feet (6.63 feet thick) with the gel progenitor overlying the reactant zone at 20.64 feet to 29.19 feet (8.55 feet thick).

Using the process which is the subject of this patent, it is clear that the placement of gels or polymers at desired locations in the reservoir is exact and can readily be achieved by this process with accuracies far in advance of any other gel or polymer formation process.

It will be readily appreciated that this invention features several specific advantages. First, the invention allows the operator to predetermine the location of the filter/sieve or blocking gel or polymer at a specific depth in the reservoir formation. Second, the invention allows the operator to determine the thickness of the filter/sieve or blocking zone. Third, the invention gives the operator greater control over the placement and thickness of the filter/sieve or blocking gels or polymers than ever before. The reactive chemicals participating in the gel or polymer formation are independently injected into the reservoir, and the volumes and concentrations can be accurately controlled to achieve the desired results. Fourth, by design, the previously ubiquitous problem of premature chemical reaction is not possible in the practice of the invention. The gel or polymer forming chemicals only come into contact with one another at the predetermined location and depth in the reservoir. Fifth, the placement of the blocking gel or polymer chemicals will be preferentially located in high permeability zones present in the reservoir formation. As a consequence, unwanted water flow into and out of these high permeability zones will be preferentially diminished once gelation or polymerization and formation of the filter/sieve or blockage has occurred. Sixth, all chemical solutions used in this process have low viscosity values between 1 and 5 cps (centipoises) and hence behave in a manner close to water itself. Injection of these low viscosity fluids will take place preferentially into the high permeability high water cut zones from which water production is the greatest. These high water cut zones are the target for effective and long lasting blockage.

An additional comment about the advantage of precise placement is in order. The placement of the blocking gel at a selected depth of penetration into the reservoir formation can be made at a location where the average (or, superficial) velocity of injected or produced flow can be ideal for minimal physical destruction of or breakdown of, the blocking gel.

Figure 8:
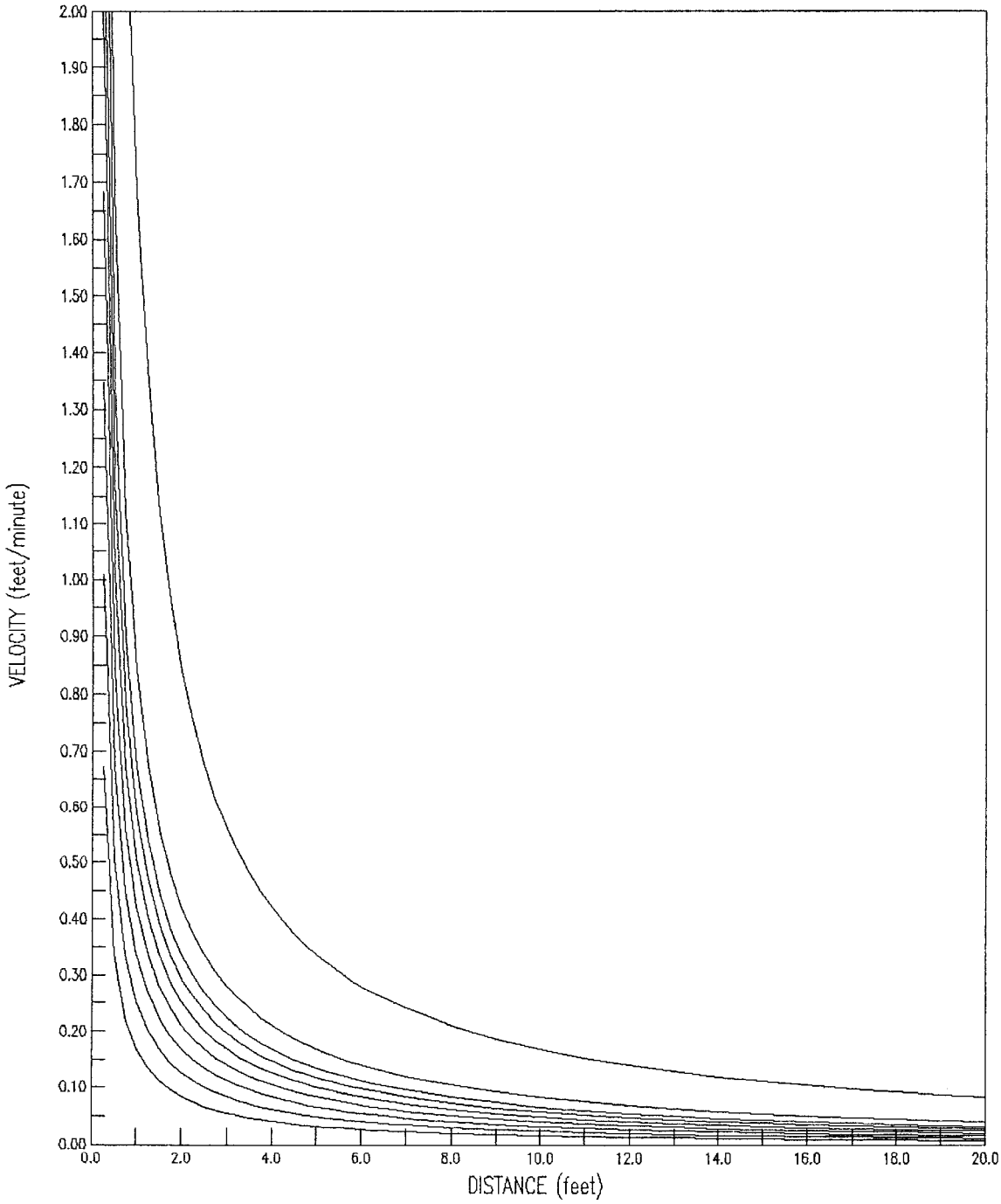
FIG. 8 is a plot of flow velocity at specific distances from the well bore for differing production volumes (BOPD) of fluid.

For example, the velocity flow profile of injection or production rates of 1000, 1500, 2000, 2500, 3000, 3500, 4000, 5000 and 10,000 barrels of water per day (for a 10 meter (32.81 feet), 1.0 darcy permeability 0.30 porosity sand interval) versus depth of penetration into the reservoir in feet, are shown in FIG. 8. At distances of 4 feet into the formation velocities range from less than 0.05 feet per minute for the 1000 BWPD case to in excess of 0.4 feet per minute for the 10,000 BWPD rate. The flow velocities increase quite rapidly from a radius of 2 feet to the well bore. Note that, at distances of 20 feet from the well bore, flow velocities are significantly lower (i.e., less than 0.05 to 0.1 feet per minute). The invention makes it possible to effectively and confidently place the blocking gel at just such a distance or greater if desired. The result is an accurately placed filter/sieve or gel, which will more effectively block fluid over time, because the aggregate (or, superficial) fluid flow rate through the blocking gel will be lower. There will inherently be fewer problems of breakdown and/or water breakthrough in wells treated according to this emplacement process.

The emplacement process also has novel and unique features applicable to the sequential injection of chemical mixture banks and spacer push volumes consisting of, but not necessarily limited to, a water soluble crosslinkable gel or polymer component or a mixture of water soluble crosslinkable gel or polymer components, a water soluble crosslinking agent or mixture of crosslinking agents, a water soluble polymerization catalyst or mixture of catalysts, a retarding or sequestering anion or anion mixture and appropriate spacer mixture of reactive or nonreactive chemicals.

In the prior art, no mention has been made of using knowledge of the partitioning characteristics between accessible immobile residual oil in the reservoir and crosslinkable chemical components, crosslinking chemical agents or other chemicals used in the formation of inorganic and organic gels and polymer blocking systems, as a means of controlling the fluid flow injection velocities to achieve in situ emplacement of the reactive chemicals.

As a further embodiment of the described emplacement process, the use as the reactive chemical of crosslinkable polymer or mixtures of crosslinkable polymers chosen from, but not limited to, polyacrylamides, partially hydrolyzed polyacrylamides, polysaccharides, carboxymethylcellulose, polyvinyl alcohol, polystyrene sulfonates, polyacrylonitriles, partially hydrolyzed polyacrylonitriles, polyacrylic acid, polyvinylpyrrolidone, copolymers of acrylonitrile with acrylic acid or 2-acrylamido-2-methyl-1 propane sulfonic acid, copolymers of acrylamide and acrylic acid or vinylic or polyolefinic monomers, partially hydrolyzed copolymers of acrylamide and acrylic acid or vinylic monomers or polyolefinic monomers, copolymers of acrylonitrile and acrylic acid or vinylic or polyolefinic monomers, partially hydrolyzed copolymers of acrylonitrile and acrylic acid or vinylic or polyolefinic monomers, copolymers of acrylic acid and vinylic or polyolefinic monomers, partially hydrolyzed copolymers of acrylic acid and vinylic or polyolefinic monomers or any and all methylated or sulfomethylated forms of the above (as presented in U.S. Pat. No. 4,488,601); or crosslinkable polymers of the type dimethyl-aminoethyl methacrylate, diethylamino methyl methacrylate, dimethylamino propyl methacrylate, diethylaminoethyl methacrylate, dimethylaminoethyl methacrylate, diethylaminoethyl acrylate, diethylaminomethyl acrylate, dimethylaminopropyl acrylate and mixtures thereof (as presented in U.S. Pat. No. 4,558,741); or crosslinkable components of the type, but not limited to, polyvinyl alcohols, polyvinyl alcohol copolymers, copolymer of polyvinyl alcohol with crotonic acid or acrylic acid or methacrylic acid or vinyl pyridine or vinylacetate or mixtures thereof (as presented in U.S. Pat. No. 4,664,194); or lignosulfonate or sulfonated Kraft lignins (as presented in U.S. Pat. No. 4,721,161); or crosslinkable components such as, but not limited to, polyalkylenimines and polyalkylene polyamines, polymeric condensates of low molecular weight polyalkylene polyamines and a vicinal dihaloalkane, polyalkylenimines and mixtures thereof comprising polymerized ethylenimine or propylenimine and polyalkylenepolyamines from polymerized polyethylene and polypropylene (as presented in U.S. Pat. No. 4,773,481 and 4,773,482); or crosslinkable components of the type, but not limited to, polyacrylamides, homopolymers of acrylamide and methacrylamide, copolymers of acrylamide and methacrylamide, polymers with carboxamide groups hydrolyzed to carboxyl groups and as salts of ammonium, alkalimetals and others, and copolymers of acrylamide with ethylenically unsaturated monomers, copolymers of methacrylamide with ethylenically unsaturated monomers, with suitable classes of ethylenically unsaturated monomers being acrylic acid, methacrylic acid, vinylsulfonic acid, vinylbenzylsulfonic acid, vinylbenzenesulfonic acid, vinyl acetate, acrylonitrile, methyl acrylonitrile, vinyl alkyl ether, vinyl chloride, maleic anhydride, vinyl-substituted cationic quaternary ammonium salt and the like, as well as the hydrolyzed or partially hydrolyzed forms of the above, copolymers of acrylamide or methacrylamide with the monomer 2-acrylamido-2-methyl-propanesulfonicacid, AMPS (AMPS® is the registered trademark of the Lubrizol Corporation of Cleveland, Ohio) and sodium salts, copolymers of acrylamide or methacrylamide and (acryloyloxyethyl) diethylmethyl ammonium methyl sulfate, DEMMS, and copolymers of acrylamide and methacrylamide and (methacryloyloxyethyl) trimethylammonium methylsulfate, MTMMS, and high molecular weight vinyl lactam polymers and copolymers such as, but not limited to, acrylamide and N-vinyl-2-pyrrolidone (as presented in U.S. Pat. Nos. 4,915,170, 2,625,529, 2,740,522, 2,727,557, 2,831,841, 2,909,508, 3,507,707, 3,768,565, 3,573,263, 4,644,020 and 4,785,028); and crosslinkable components of the type, but not limited to, carboxylate polymers such as polysaccharides, modified polysaccharides, guar gum, carboxymethylcellulose, acrylamide, polyacrylamide, partially hydrolyzed polyacrylamides and terpolymers of acrylamide, acrylate and a third species (as presented in U.S. Pat. No. 5,010,954); and crosslinkable components such as, but not limited to, polyvinyl alcohol, copolymers of polyvinyl alcohol with methyl acrylate, methyl methacrylate, acrylamide, methacrylic acid, acrylic acid, vinyl pyridine and 1-vinyl-2-pyrrolidinone (as presented in U.S. Pat. No. 5,061,387); and crosslinkable components such as, but not limited to, acrylamide, vinyl acetate, acrylic acid, vinyl alcohol, methacrylamide, ethylene oxide, propylene oxide, vinyl pyrrolidone, polyvinyl polymers, polymethacrylamides, cellulose ethers, polysaccharides, lignosulfonates (ammonium salts), lignosulfonates (alkali metal salts), lignosulfonates (alkaline earth salts) and copolymers of the type acrylic acid with acrylamide, acrylic acid with methacrylamide, polyacrylamides, partially hydrolyzed polyacrylamides, partially hydrolyzed polymethacrylamides, polyvinyl alcohol, polyvinyl acetate, polyvinyl pyrrolidone, polyalkylene oxides, carboxycelluloses, carboxyalkylhydroxyethyl celluloses, hydroxyethylcellulose, galactomannans (guar gum), substituted galactomannans (hydroxypropyl guar), heteropolysaccharides resulting from the fermentation of starch derived sugar (xanthan gum) and ammonium and alkali metal salts thereof (as presented in U.S. Pat. No. 5,145,012); and crosslinkable components such as, but not limited to, hydrophilic polymers such as polyvinyl polymers, polymethacrylamides, cellulose ethers, polysaccharides and the ammonium and alkali metal salts thereof and copolymers of the type acrylic acid-acrylamide, acrylic acid-methacrylamide, polyacrylamides, partially hydrolyzed polyacrylamides, partially hydrolyzed polymethacrylamides, polyvinyl alcohol, polyvinyl acetate, polyvinyl pyrrolidone, polyalkyleneoxides, carboxyalkylcelluloses, carboxymethyl cellulose, carboxyalkylhydroxyethyl celluloses, hydroxyethylcellulose, galactomannans (guar gum), substituted galactomannans (hydroxypropyl guar), heteropolysaccharides (xanthan gum fermentation products) and ammonium and alkali metal salts thereof (as presented in U.S. Pat. No. 5,161,615); and crosslinkable components such as, but not limited to, homopolymers of acrylamide, homopolymers of methacrylamide, copolymers of acrylic acid and acrylamide, potassium acrylate and acrylamide, sodium acrylate and methacrylamide, sodium acrylate and acrylamide, acrylamide and N,N-dimethacrylamide, acrylamide and methacrylamide, acrylamide and sodium 2-acrylamido-2-methylpropane sulfonate, acrylamide and N-vinyl-2-pyrrolidone, terpolymers of acrylamide, N,N-dimethylacrylamide and 2-acrylamido-2-methylpropane sulfonate, terpolymers of acrylamide, N-vinyl-2-pyrrolidone and sodium 2-acrylamido-2-methylpropane sulfonate and polysaccharides such as xanthans, glucans, and cellulosics (as presented in U.S. Pat. No. 5,259,453); and crosslinkable components such as, but not limited to, guar gum, derivatized guar gum, derivatized cellulose, polysaccharide polymers containing carboxymethyl groups, carboxymethyl guar, carboxymethylhydroxyethyl guar, carboxymethylhydroxypropyl guar, carboxymethylhydroxyethyl cellulose and carboxymethylhydroxypropyl cellulose (as presented in U.S. Pat. No. 5,271,466); and crosslinkable oligomers of furfuryl alcohol (as presented in U.S. Pat. No. 5,285,849) which have a partition coefficient interaction with in-place accessible nonmobile residual oil can be used in this process.

Crosslinking agents, which have found particular application associated with the in situ geling or in situ polymerization of crosslinkable geling-polymerizable components and which may have a partitioning interaction with accessible immobile residual oil as described above can be used in the embodiment of this emplacement process and are of the type, but not limited to, such components as multivalent cations like $Fe^{2+}$, $Fe^{3+}$, $Al^{3+}$, $Ti^{4+}$, $Zn^{2+}$, $Su^{2+}$, $Ca^{2+}$, $Mg^{2+}$, $Cr^{3+}$ (as presented in U.S. Pat. No. 4,488,601); or crosslinking agents such as, but not limited to, methacrylic acid, acrylic acid or Na or K salts thereof or mixtures thereof, mineral acids such as hydrochloric acid, hydrofluoric acid, phosphoric acid, organic acids such as acetic acid, formic acid, citric acid, cationic surfactants, nonionic surfactants, anionic surfactants and anions such as $Cl^-$, $Br^-$, $I^-$, $F^-$, sulfates, carbonates and hydroxides (as presented in U.S. Pat. No. 4,558,741); or crosslinking agents such as, but not limited to, monoaldehydes such as acrolein and acrolein dimethylacetal, dialdehydes such as glyoxal, malonaldehyde, succinaldehyde, glutaraldehyde, adipaldehyde, terphthaldehyde, dialdehyde derivatives such as glyoxal bisulfite ($Na_2HC(OH)SO_3CH(OH)SO_3$), glyoxal trimeric dihydrate, malonaldehyde bisdimethylacetal, 2,5-dimethoxytetrahydrofuran, 3,4-dihydro-2-methoxy-2H-pyran, furfural, acetals, hemiacetals, cyclic acetals, Shiffs bases, polyaldehydes such as polyacrolein dimethyl acetal and addition products such as ethylene glycol and acrolein, glycerol and acrolein (as presented in U.S. Pat. No. 4,664,194); or crosslinking agents such as, but not limited to, acrylamide or acrylic acid monomers (as presented in U.S. Pat. No. 4,721,161); or crosslinking agents such as, but not limited to, anionic or nonionic polymers which can be hydrolyzed to anionic monomers of anionic polymers such as polyacrylamide, alkylpolyacrylamides, copolymers of polyacrylamide or alkylpolyacrylamides with ethylene, propylene and styrene, polymaleic anhydride and polymethacrylate and hydrolysis products or mixtures thereof (as presented in U.S. Pat. No. 4,773,481); or crosslinking agents such as, but not limited to, difunctional compounds such as aldehydes, ketones, alkyl halides, isocyanates, compounds with activated double bonds, carboxylic acids, glutaraldehyde, succinaldehyde, 2,4-pentadione, 1,2-dichloroethane, 1,3-diisocyanopropane, dimethylketene, adipic acid and others (as presented in U.S. Pat. No. 4,773,482); or crosslinking agents such as, but not limited to, water soluble amino-plastic resins with aldehyde components such as formaldehyde, glyoxal, urea (as presented in U.S. Pat. No. 4,838,352); or crosslinking agents such as, but not limited to, mixtures of naphtholic compounds and phenolic compounds with aldehydes, phenolic resins and amino resins or with polyvalent metal cations such as $Al^{3+}$, $Cr^{3+}$, $Fe^{3+}$, $Sb^{3+}$, $Zr^{4+}$, phenolic resins resulting from condensation of phenol or substituted phenols such as resorcinol, catechol, 4,4'-diphenol, 1,3-dihydroxynaphthalene, pyrogallol, phloroglucinol with formaldehyde, acetaldehyde, furfural, proprionaldehyde, butylaldehyde, isobutylaldehyde, heptaldehyde, glyoxal, glutaraldehyde, terephthaldehyde and esterified phenols and naphthols (as presented in U.S. Pat. No. 4,915,170); or crosslinking agents such as, but not limited to, chromic carboxylate complexes (as presented in U.S. Pat. No. 5,010,954); or crosslinking agents such as, but not limited to, partially methylated melamine-formaldehyde resins (as presented in U.S. Pat. No. 5,061,387); or crosslinking agents such as, but not limited to, aldehydes, dialdehydes, phenols, substituted phenols, ethers, phenol, resorcinol, glutaraldehyde, catechol, formaldehyde, divinyl ether, and inorganic agents such as polyvalent metal cations, chelated polyvalent metals, $Cr^{3+}$, $Al^{3+}$, gallates, dichromates, titanium chelates, aluminum citrate, chromium citrate, chromium acetate, chromium propionate, (as presented in U.S. Pat. No. 5,145,012); or crosslinking agents such as, but not limited to, aldehydes, dialdehydes, phenols, substituted phenols, ethers, phenol, resorcinol, glutaraldehyde, catechol, formaldehyde and divinyl ether (as presented in U.S. Pat. No. 5,161,615); or crosslinking agents such as, but not limited to, mixtures of phenol, formaldehyde, resorcinol, furfuryl alcohol (as presented in U.S. Pat. No. 5,259,453); or crosslinking agents such as, but not limited to, $Sb^{3+}$, $Cr^{3+}$, $Ti^{4+}$, $Zr^{4+}$, zirconium lactate, zirconium carbonate, zirconium acetylactonate, zirconium diisopropylamine lactate, potassium pyroantimonate, titanium actylacetonate, titanium triethanolamine, chromium citrate (as presented in U.S. Pat. No. 5,271,466); or crosslinking agents such as, but not limited to, and catalytic acids of the type orthonitrobenzoic acid, $_p$-toluenesulfonic acid, hydrochloric acid, nitric acid, sulfuric acid, xylenesulfonic acid, oxalic acid, iodic acid, maleic acid, dichloroacetic acid, trichloroacetic acid, o-nitrobenzoic acid, chloroacetic acid, phosphoric acid, acetic acid, benzoic acid, adipic acid and the like (as presented in U.S. Pat. No. 5,285,849).

The cited patents also make reference to the use of other chemicals and additives and agents which may have partitioning interactions with residual oil in the reservoir formation. These chemicals may also be considered as part of the embodiment of this emplacement process. Such chemicals included herein relate to retarding anions such as ethylenediaminetetraacetic acid and salts thereof, acetate nitrilotriacetate, tartrate, citrate, tripolyphosphate, metaphosphate, gluconate, orthophosphate, and cationic complexing agents such as citric acid, tartaric acid, maleic acid and the alkali metal salts thereof (as presented in U.S. Pat. No. 4,488,601); aqueous mixtures of methanol, ethanol, isopropanol (as presented in U.S. Pat. No. 4,558,741); acid catalysts of the type, but not limited to, Bronsted Acids and Lewis Acids, $ZnCl_2$, $FeCl_2$, $SnCl_2$, $AlCl_3$, $BaF_2$, $SO_3$, and delayed action catalysts such as sodium persulfate and reducing agent(s), methyl formate, ethyl formate, methyl acetate, ethyl acetate, glycerol monoacetate, acetin, glycerol diacetate (diacetin), sodium dodecyl sulfate, methyl methane sulfonate, sodium triiodide and sodium bisulfite, sulfones, xanthates, xanthic acids, thiocyanates (as presented in U.S. Pat. No. 4,664,194); chemical initiators of the type, but not limited to, persulfate or hydroxylamine with various concentrations of polyvalent cations $Fe^{3+}$, $Ti^{3+}$, $V^{3+}$, $Cr^{3+}$, $Mo^{3+}$ (as presented in U.S. Pat. No. 4,721,161); nickel chloride hexahydrate ($NiCl_26H_2O$), calcium chloride ($CaCl_2$) (as presented in U.S. Pat. No. 4,838,352); ethylenediamine tetraamine and sodium salts thereof (as presented in U.S. Pat. No. 5,010,954); organic acids such as, but not limited to, acetic acid, formic acid, lactic acid, sulfamic acid, esters such as methyl acetate, ethyl formate, ethyl lactate, ethyl acetate, ethylene diacetate, 2-chloroacetamide, and inorganic acids and alkali metal salts of phosphoric acid, fluoroboric acid (as presented in U.S. Pat. No. 5,061,387); delayed acting agents such as, but not limited to, hydrolyzable esters, acid anhydrides, sulfonates, organic halides, salts of strong acid-weak base, ethyl formate, propyl formate, ethyl acetate, glycerol monoacetate, acetin, glycerol diacetate, diacetin, xanthanes, thiocyanates, polyethylene esters, ethylacetate esters, acrylate copolymers, dimethyl esters, dibasic esters (as presented in U.S. Pat. No. 5,145,012); carrier fluid components such as, but not limited to, petroleum derivatives such as kerosene, diesel, mineral oil, lube oil, crude oil, alcohols such as methanol, isopropyl alcohol, and solvents such as toluene, xylene, acetone (as presented in U.S. Pat. No. 5,161,615); and diluent components of the type, but not limited to, butyl acetate, methyl acetate, ethyl acetate, propyl acetate, methanol (as presented in U.S. Pat. No. 5,285,849).

EXAMPLE 5

Using the injection method illustrated in Examples 1–4, and the appropriate volumes and chemical concentrations and rates of injection needed to achieve the desired placement of the filter/sieve in the reservoir formation, $V_2$, of a polymer reactive chemical, such as polyacrylamide, is first injected into the formation, followed by a spacer volumn, $V_3$, and a second chemical volume, $V_4$, comprising a mixture of an organic acid, such as acetic acid, and a crosslinking multivalent cationic salt , such as chromium nitrate, followed by the required push volumes. In this example a crosslinked filter/sieve is formed.

The order of sequential injection of the various reactive water soluble chemical banks and spacer push volumes will be totally determined by the partition coefficient value measured for each water soluble chemical component and the accessible residual oil saturation ($AS_{or}$) of the receiving formation. These partition coefficient values can be measured for the specific oil system and for the specific chemical components being used. The higher the partition coefficient for any injected chemical, the slower will be its movement through the reservoir since its residence time in the immobile oil phase will be greater. For chemicals sequentially injected into a formation, and for which each has a partition coefficient value, $K_1$ and $K_2$, ($K_1>K_2$) then the order of injection would be that chemical which has the higher partition coefficient first ($K_1$) followed by the chemical with the lower partition coefficient ($K_2$). The rate of retardation of the two (2) chemicals will be a function of the difference between the two partition coefficients.

The ability to place an efficient stable gel blockage at a predetermined distance into a reservoir formation primarily sealing or controlling fluid flow through the high permeability zones and at a distance where the velocity of fluid flow is such that the integrity of the gel is effectively maintained for high volume fluid injection and production flow rates, has three (3) major applications (1) production fluid control (2) injection fluid control (3) sand and mineral fines production control; i.e. (a) in oil and gas producing wells which penetrate productive reservoir formations, (b) in high water cut oil and gas producing wells which are now in watered out reservoir formations which still contain mobile residual oil and gas, (c) in high volume flow —high injection rate water injection wells. The use of this technology is not however limited to only the three (3) major applications foreseen at this time but has direct application for any function which requires fluid flow controls in oil and gas wells, to be abandoned oil and gas wells and in abandoned oil and gas wells.

One preferred application of the process described herein is to use the process as a means of effectively and preferentially blocking, by gel or polymer formation, the high permeability zones in which preferential water breakthrough has occurred thereby diminishing the production of oil and/or gas from the productive reservoir interval. Placing blockage at preferred depths of penetration preferentially in the high permeability zones will allow ensuing diminished water production with an improved sweep of oil through and from the less permeable strata.

A second preferred application of the process is in the treating of oil and gas production wells in which water or gas coning has occurred close to the well bore thereby diminishing the production of oil and gas due to the preferred flow of formation water. Placement of a gel or polymer block at the base or sides of the water or gas cone will enable selective removal of the water or gas cone by appropriate treatment with suitable water solubilizing or gas solubilizing chemicals to be made. Following removal of the cone effect, bringing the well back onto production at non-coning conditions will allow oil and/or gas production to be re-established from the previously nonproductive reservoir interval.

A third preferred application of the process is in the control and prevention of sand production from the producing interval. Sand production associated with oil and gas production is extremely costly in terms of the severe erosive effects of the sand flow on valves, tubing and both down hole and surface equipment. Placement of a suitable gel blockage at preferred depths in the reservoir formation can effectively diminish high velocity flow through high permeability zones within the reservoir formation as well as diminishing sand flow by essentially forming a uniformly low permeability sand barrier blockage around the well at low velocity flow locations. Similarly, certain gel placement conditions whereby the gel is preferentially set up close to the well bore, can also be used to diminish sand flow.

A fourth preferred application of the process is in the control of mineral fines production such as Kaolinite production associated with various types of reservoir formation damage. The movement of inorganic clay-related and other inorganic mineral-related fines can effectively diminish the reservoir formation permeability characteristics particularly associated with unfavorably high velocity flow of fluids close to the well bore. Placement of a suitably located gel blockage at preferred depth in the reservoir can effectively diminish the movement of mineral fines and thereby diminish the undesired clogging of the reservoir permeability channels.

A fifth preferred application of the process is in the improvement of reservoir formation injection water flow whereby the placing of an effective blocking gel present within the high permeability or channel zones present in the formation will allow a more effective sweep of injection water through the less permeable intervals of the reservoir formation thereby improving oil and gas mobility drive towards productive wells. Location of the gel blockage at low velocity water flow distances from the well bore provides a condition whereby the physical stability of the gel will not be compromised by the fluid flow velocity or drive energy.

A sixth preferred application relates specifically to the blockage of water flow from gas wells by first injecting oil or diesel into the reservoir and then intentionally reducing the oil content to a waterflood residual oil level by flood injection thereby rendering the reservoir suitable for the desired injection requirements of this embodiment. This process could rejuvenate a water producing gas well back to gas production.

We claim:

1. A method for forming a gel or polymer filter in a producing zone at least four feet from the bore of a producing well which has residual oil in said zone which comprises:

a. injecting a first carrier fluid containing a reactive material that has a partitioning coefficient $K_1$, with respect to in-place immobile hydrocarbon that will mix with said residual oil;

b. injecting a spacer fluid;

c. injecting a second carrier fluid containing a gel or polymer progenitor fluid, wherein the gel or polymer progenilor fluid has a partitioning coefficient $K_0$ with respect to the in-place immobile hydrocarbon which is less than $K_1$; wherein the gel or polymer progenitor fluid catches up with and superimposes with the reactant fluid to form said filter/sieve of blocking gel or polymer at the desired distance from the well.

2. The method of claim 1 which further includes:

injecting a conditioning fluid prior to injecting said first carrier fluid.

3. The method of claim 2, wherein the conditioning fluid is selected from the group consisting of:

a. water soluble alkali metal salts;

b. water soluble alkali metal organic acid and multi-basic acid salts;

c. water soluble organic alcohols;

d. water soluble inorganic and organic acids; and e. petroleum related hydrocarbon or hydrocarbon mixtures thereof.

4. The method of claim 2, wherein the conditioning fluid is selected from the group consisting of:

a. water soluble alkali metal salts of lithium, sodium or potassium and ammonia including inorganic hydroxides, chlorides, nitrates, nitrites, chlorates, sulfites, sulfates, phosphates, bicarbonates and carbonates;

b. water soluble alkali metal organic acid salts of lithium, sodium, potassium and ammonia including formates, acetates, propionates and multi-basic acid salts including citrates, tartarates, maleicates, ethylenediaminetetracetic acid, diaminetetracetic acid, diethylenetriaminepentacetic acid, cyclohexane trans-1,2-diaminetetracetic acid, ethanoldiglycine, diethanol glycine, hydroxyethyl-ethylenediamine tetracetic acid, ethylene bis (2-orthohydroxyphenyl glycine, and nitrilotriacetic acid;

c. water soluble organic alcohols including methanol, ethanol, n-propanol, isopropanol, butanol, isobutanol and pentanol;

d. water soluble acids including hydrochloric acid, hydrofluoric acid, phosphoric acid, boric acid, formic acid, acetic acid, propionic acid, and citric acid; and e. petroleum related hydrocarbon or hydrocarbon mixtures thereof including kerosene, diesel, condensates and crude oils and blended mixtures thereof.

5. The method of claim 1, wherein said reactive chemical in said first carrier fluid is an ester.

6. The method of claim 1, wherein said reactive chemical in said first carrier fluid is a soluble polymer.

7. A method of forming a filter/sieve of a blocking gel or polymer at a predetermined distance from a borehole in a hydrocarbon-bearing or nonhydrocarbon-bearing formation into which a hydrocarbon is injected, the method comprising:

a. injecting a conditioning fluid, said fluid having a zero partitioning coefficient $K_0$, or a low partitioning coefficient $K_1$, with respect to in place hydrocarbon;

b. injecting a first carrier fluid containing a reactive material, said reactive fluid having a nonzero partitioning coefficient $K_2$ with respect to the in-place hydrocarbon;

c. injecting a spacer fluid;

d. injecting a second carrier fluid containing a gel or polymer progenitor fluid, the gel or polymer progenitor fluid having a partitioning coefficient $K_3$ with respect to the in-place hydrocarbon which is less than $K_2$; wherein the partitioning coefficients $K_2$ and $K_3$ are selected so that the gel or polymer progenitor fluid moves through the formation faster than the reactive fluid and wherein the gel or polymer progenitor fluid catches up with and superimposes the reactive fluid to form the filter/sieve of blocking gel or polymer at the desired distance from the borehole.

8. The method of claim 7, wherein:

the reactive chemical is an organic ester; and the gel or polymer progenitor includes a silicate.

9. The method of claim 8, wherein said ester is selected from the group consisting of ethyl formate, methyl acetate, and ethyl acetate.

10. The method of claim 8, wherein the gel or polymer progenitor fluid includes sodium silicate.

11. The method of claim 7 wherein:

said reactive fluid is a soluble polymer; and said polymer progenitor is an aqueous solution of a multivalent salt.

12. A method for re-establishing oil and/or gas production from an underground formation from a well, the method comprising:

injecting a first fluid that has a partitioning coefficient $K_1$;

injecting a spacer fluid into said well;

injecting a second fluid that has a partitioning coefficient $K_0$ into the well, wherein one fluid is a reactive fluid and the other fluid is a gel or polymer progenitor fluid and $K_0$ is less than $K_1$, whereby said fluid that has a partitioning coefficient $K_0$ catches up with and superimposes with said fluid that has a partitioning coefficient $K_1$ to form a filter/seive of blocking gel or polymer at a desired distance from said well in the formation, and re-establishing oil and/or gas production from the well, whereby said filter/seive in the formation prevents water breakthrough.

13. The method of claim 12 wherein the amount of second injected fluid is reduced by injecting a push fluid.

14. The method of claim 12, wherein said reactive fluid is an ester.

15. The method of claim 12 further comprising injecting a conditioning fluid prior to injecting as the first fluid, whereby the temperature of the formation is reduced.

* * * * *